US005612092A

United States Patent [19]

Strenger et al.

[11] Patent Number: 5,612,092

[45] Date of Patent: Mar. 18, 1997

[54] KNIFE COATING METHOD USING ASCENSION OF THE FLUID BY ITS TENSION

[75] Inventors: Mark R. Strenger, Woodbury; Robert B. Secor, Stillwater, both of Minn.; Bernhard Lenz, Kleinenbroich, Germany

[73] Assignee: Minnesota Mining and Manufacturing Company, St. Paul, Minn.

[21] Appl. No.: 319,266

[22] Filed: Oct. 6, 1994

[51] Int. Cl.[6] ..... B05D 3/12

[52] U.S. Cl. ..... 427/356; 427/434.3; 118/126; 118/410; 118/413

[58] Field of Search ..... 118/413, 410, 118/126; 427/356, 434.3

[56] References Cited

U.S. PATENT DOCUMENTS

| | | | |
|---|---|---|---|
| 3,038,441 | 6/1962 | Wamsley | 118/126 |
| 3,638,604 | 2/1972 | Herzhoff et al. | 118/410 |
| 5,399,376 | 3/1995 | Flinchum et al. | 427/424.3 |

FOREIGN PATENT DOCUMENTS

| | | |
|---|---|---|
| 0545084A1 | 6/1993 | European Pat. Off. . |
| 0609768A1 | 8/1994 | European Pat. Off. . |
| 3906070A1 | 9/1990 | Germany . |

*Primary Examiner*—Katherine A. Bareford
*Attorney, Agent, or Firm*—Gary L. Griswold; Walter N. Kirn; Charles D. Levine

[57] ABSTRACT

To knife-coat elastic liquids without the presence of flow instability, the extension rate in the upstream region of the coating bead is kept low by increasing the distance over which the liquid must accelerate. The onset of the flow instability is delayed by insuring that the upstream liquid-air interface of the coating bead is relatively long and flat. This is accomplished by allowing the elastic liquid to pull itself over a relatively large distance out of a trough and into the knifing passage. The liquid is able to ascend into the knifing passage by virtue of liquid tension developed by the extensional flow in the upstream region of the coating bead.

8 Claims, 3 Drawing Sheets

KNIFE COATING METHOD USING ASCENSION OF THE FLUID BY ITS TENSION

TECHNICAL FIELD

The present invention relates to knife coating methods of applying coatings to webs. More particularly, the present invention relates to improved knife coating methods for viscoelastic liquids.

BACKGROUND OF THE INVENTION

Coating is the process of replacing the gas contacting a substrate, usually a solid surface substrate, with a layer of fluid, such as a liquid. Sometimes multiple layers of a coating are applied on top of each other. Often the substrate is in the form of a long continuous sheet, such as a web, wound into a roll. Examples are plastic film, woven or non-woven fabric, or paper. Coating a web typically involves unwinding the roll, applying the liquid layer to the roll, solidifying the liquid layer, and rewinding the coated web into a roll.

After deposition of a coating, it can remain liquid such as when applying lubricating oil to metal in metal coil processing or when applying chemical reactants to activate or chemically transform a substrate surface. Alternatively, the coating can be dried if it contains a volatile liquid, or can be cured or otherwise treated to leave behind a solid layer. Examples include paints, varnishes, adhesives, photochemicals, and magnetic recording media.

Methods of applying coatings to webs are discussed in Cohen, E. D. and Gutoff, E. B., *Modern Coating and Drying Technology,* VCH Publishers, New York 1992 and Satas, D., *Web Processing and Converting Technology and Equipment,* Van Vortstrand Reinhold Publishing Co., New York 1984, and include knife coaters.

Knife coating involves passing the liquid between a stationary solid member, a knife, and the web so that the clearance between the knife and the web is less than twice the thickness of the applied liquid layer. The liquid is sheared between the web and the knife, and the thickness of the layer depends to a great extent on the height of the clearance. For many materials and operating constraints, knife coaters provide smooth coatings, free of waves, ribs, or heavy edges. The web can be supported on its backside by a backup roller to eliminate the dependence of the coating process upon variations in longitudinal tension across the web, which are common with paper and plastic film substrates. The knife coater also can apply a coating directly to a roller, which subsequently transfers the coating to the web.

One feature which distinguishes various knife coaters is the way liquid is introduced to the knifing passage. Gravity-fed knife coaters, shown in FIG. 1, receive liquid from an open pool contained against the web by a hopper. Film-fed knife coaters, shown in FIG. 2, receive liquid from a layer applied to the web by other methods, but not yet with the desired thickness, uniformity, or smoothness. Any excess material runs off the knife and is collected for recycle. Die-fed knife coaters, shown in FIG. 3, receive liquid from a narrow slot which, in conjunction with an upstream manifold, distributes evenly across the web the flow feeding the knifing passage. The die includes two plates sandwiched together with a shim or a depression in one plate to form the slot passage. Trough-fed knife coaters, shown in FIGS. 4A and 4B, receive liquid from a wide slot, or trough, which is fed by a narrow slot and manifold to provide even flow distribution across the web. The coater in FIG. 4B overflows on the upweb side of the coater. The liquid overflow is recycled.

When the liquid to be coated is very elastic, knife coaters are susceptible to a flow instability in the upstream region of the coating bead where the liquid first contacts the web. (The coating bead is the liquid bridge between the applicator and the substrate.) In the upstream region of the coating bead, the liquid must accelerate from nearly zero speed to the speed of the moving web in a distance that is approximately equal to the clearance between the upstream side of the knife coater and the moving web. This accelerating flow subjects the liquid to high extension rates. Very elastic liquids exhibit a viscosity in extension (irrotational flow) which is much higher at high rates of extension than the viscosity in shear (rotational flow) at high rates of shear. The disparity between the extensional viscosity and the shear viscosity drives a flow instability in the upstream region of the coating bead which causes undesirable coating defects.

The susceptibility of the coating process to the flow instability increases with increasing coating liquid elasticity and with increasing web speed. The instability usually manifests itself as a transition from a spatially and temporally uniform coating bead on the upstream side to one which is segmented in the crossweb direction. Further increase in coating speed or liquid elasticity leads to further temporal and spatial non-uniformities in the upstream region of the coating bead. The flow instability in the upstream region of the coating bead produces coating defects in the final coated film. Ordinarily, the defects take the form of streaks or "brushmarks" oriented either parallel to the downweb direction or diagonally across the web. This flow instability occurs when coating elastic liquids in gravity-fed, die-fed, and trough-fed fed knife coaters. It may also occur in film-fed knife coaters depending on the method of depositing the original film on the web. The instability occurs when elastic liquids are coated in a knife coater in which the liquid fills a relatively small clearance at the upstream side of the coating bead.

There is a need for a method of operating knife coaters so that very elastic liquids can be coated at high speeds without inducing the flow instability and the associated coating defects.

SUMMARY OF THE INVENTION

The method of the present invention applies a coating fluid on to a surface and includes providing relative movement between a coating apparatus and the surface. Coating fluid is fed directly into a trough and is applied to the surface through the trough opening which extends transversely across the surface. The thickness of the coating is regulated using a knife. A sufficient distance between the separation line (the intersection line of the coating fluid, the upweb side of the trough, and the surrounding gas) and the wetting line (the intersection line of the coating fluid, the surface to be coated, and the surrounding gas) is maintained to eliminate the upstream coating bead flow instability.

The coating fluid can be an elastic liquid having a ratio of extensional viscosity to shear viscosity greater than 10. The trough opening can extend transversely across at least the desired width of the coating. The distance between the separation line and the wetting line can be greater than 0.5 cm. The separation line can be located below the knifing passage.

The distance between the separation line and the wetting line can be controlled by controlling the rate of liquid inflow into the trough and the rate of liquid outflow through the knifing passage.

The liquid-gas interface is the surface that connects the separation line and the wetting line at the upstream coating bead, and can be substantially flat. Also, the rheological properties of the coating liquid and the web speed can be selected to vary the rupture distance of the upstream liquid-gas interface.

The method knife-coats elastic liquids without flow instabilities by keeping low the extension rate in the upstream region of the coating bead so that the disparity between the extensional and shear viscosities of the liquid is small. The extension rate in the upstream region of the coating bead is kept low by increasing the distance over which the liquid must accelerate. The onset of the flow instability can be delayed by insuring that the upstream liquid-air interface of the coating bead is relatively flat. This is accomplished by allowing the elastic liquid to pull itself over a relatively large distance out of a trough and into the knifing passage. The liquid ascends into the knifing passage by virtue of liquid tension developed in the extensional flow in the upstream region of the coating bead.

DETAILED DESCRIPTION

Conventional knife coating of elastic liquids is susceptible to a flow instability in the upstream region of the coating bead. When relatively inelastic liquids are coated or in some instances when the coating speed is kept low, the flow instability is absent and the upstream liquid-air interface of the coating bead is spatially and temporally uniform. However, when either the elasticity of the liquid or the web speed increases, the flow in the upstream region of the coating bead may become unstable.

Figure 1:
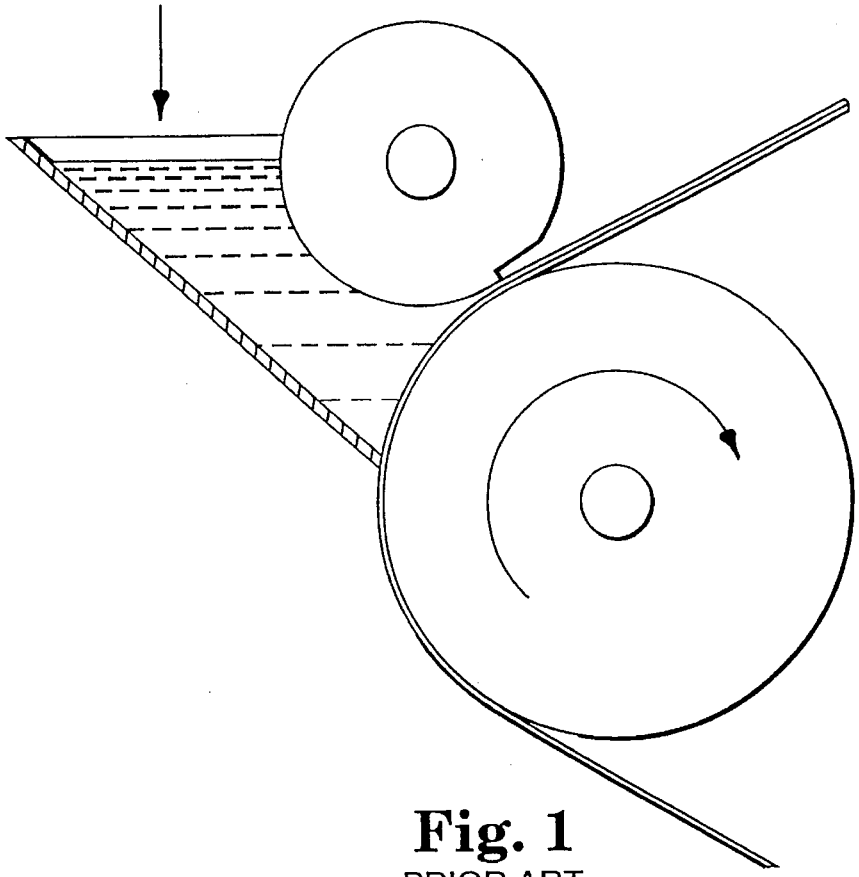
Fig. 1 PRIOR ART
FIG. 1 is a schematic view of a known gravity-fed knife coater.
Figure 2:
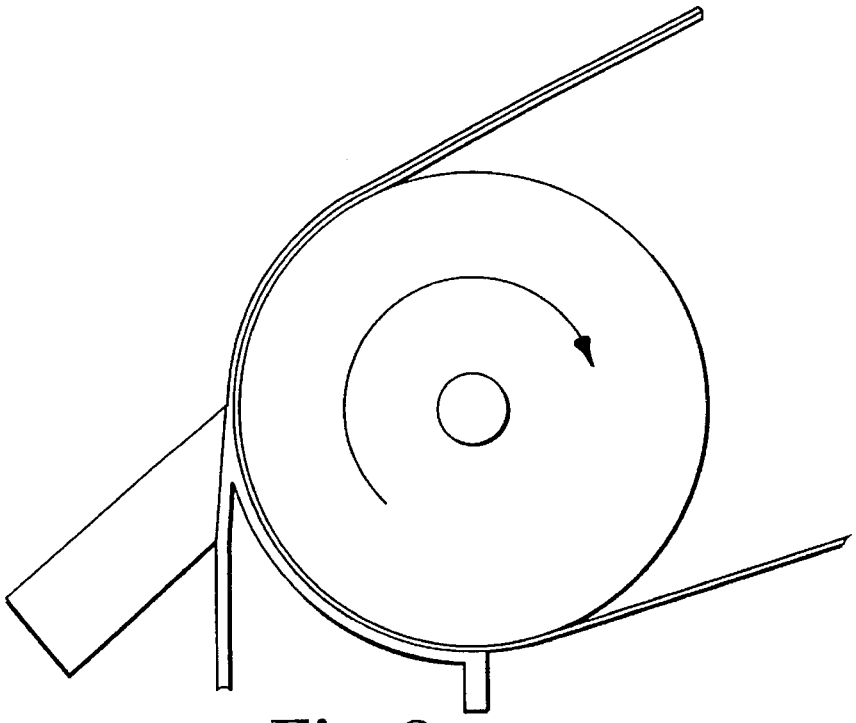
Fig. 2 PRIOR ART
FIG. 2 is a schematic view of a known film-fed knife coater.
Figure 3:
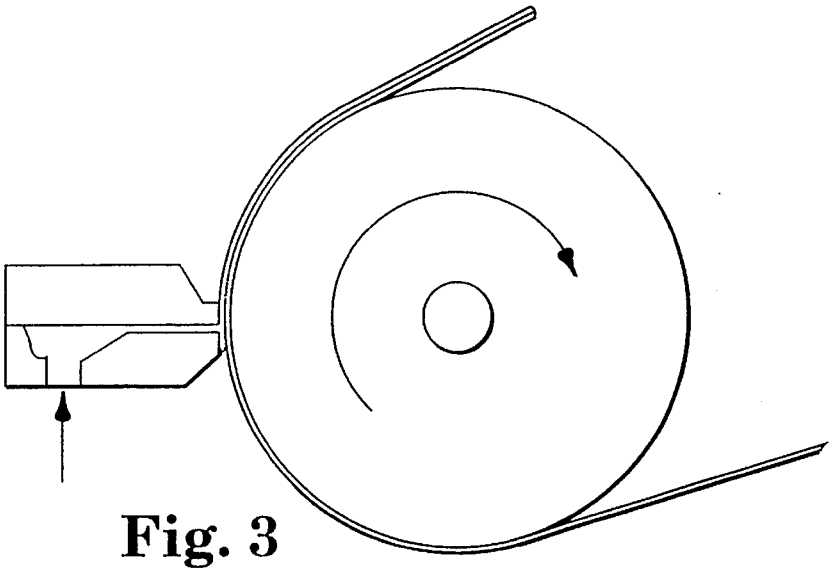
Fig. 3 PRIOR ART
FIG. 3 is a schematic view of a known die-fed knife coater.
Figure 4A:
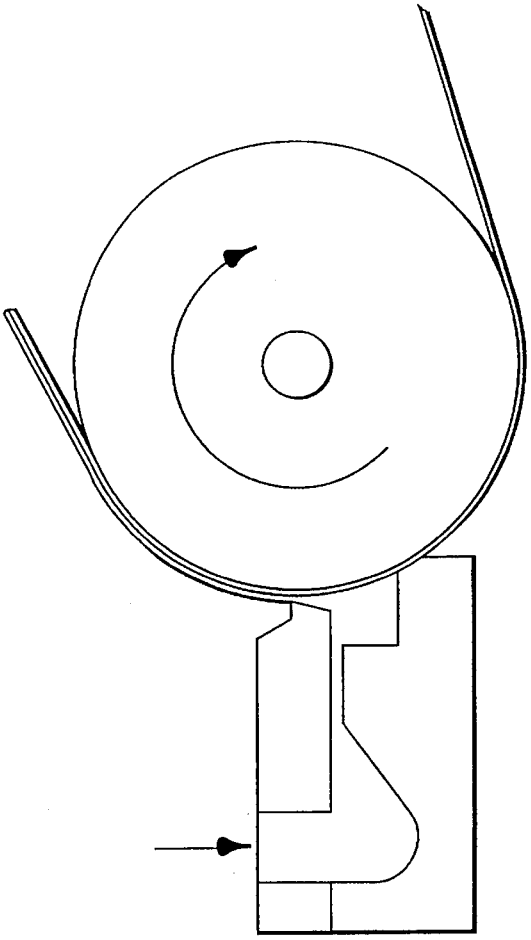
Fig. 4A PRIOR ART
FIGS. 4A and 4B are schematic views of a known trough-fed knife coater.
Figure 4B:
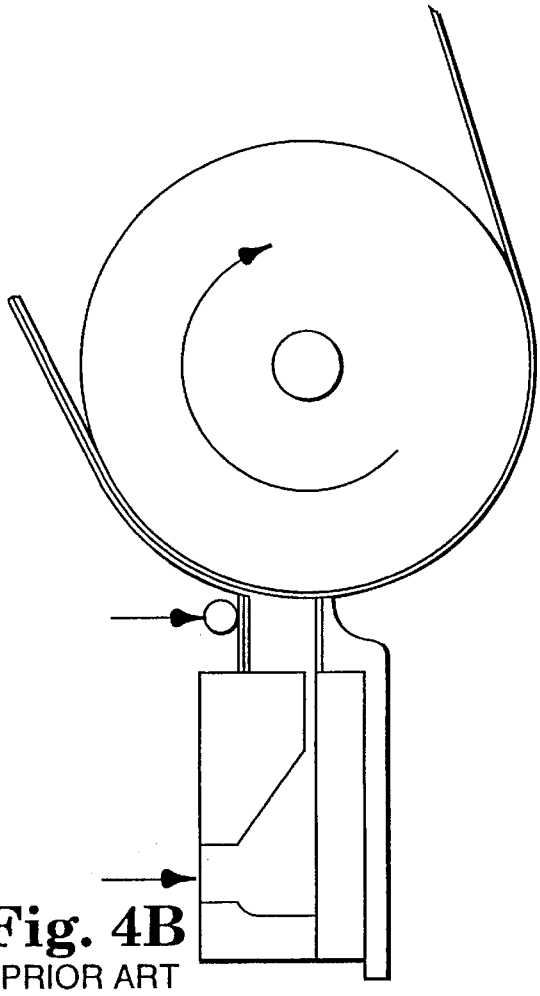
Fig. 4B PRIOR ART
Figure 5:
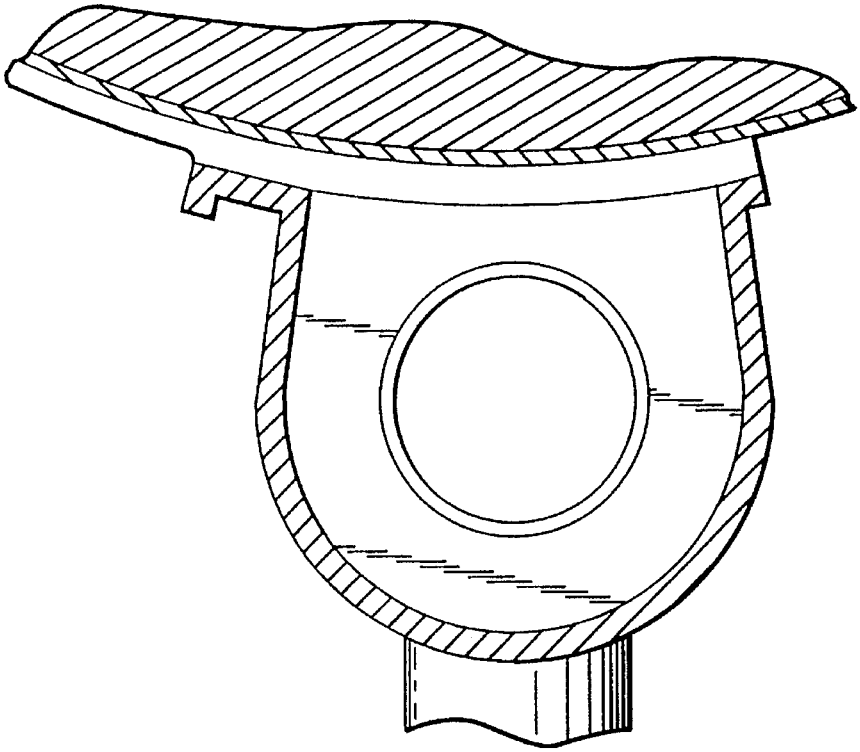
FIG. 5 is a schematic side view of a cross flow knife coater.

The crossflow knife coater, shown in FIG. 5 and disclosed in U.S. Pat. No. 5,514,416, filed on Feb. 8, 1994, is a trough-fed knife coater where the trough is fed from one of its ends. This manner of feeding, in conjunction with the motion of the web surface, creates a spiral flow along the width of the trough.

Although liquid elasticity can manifest itself in several forms, the active form in this flow instability is an enhanced extensional viscosity. The extensional viscosity is exhibited by the liquid in a purely stretching (irrotational) flow, in contrast to the shear viscosity exhibited in a shear (rotational) flow. Elastic liquids have an extensional viscosity which is comparable to their shear viscosity at low deformation rates. (Usually the extensional viscosity is 3–4 times the shear viscosity at low rates.) At higher rates of deformation, the extensional viscosity of elastic liquids usually increases (sometimes dramatically) while the shear viscosity either remains constant or decreases. The ratio of the extensional viscosity to the shear viscosity (sometimes referred to as Trouton's ratio) is a good indicator for determining whether a coating liquid is susceptible to the flow instability in the upstream region of the coating bead of a conventional knife coater. If Trouton's ratio is greater than ten in the range of deformation rates between 1 and 1000 $sec^{-1}$, then it may exhibit the upstream coating bead flow instability in conventional knife coaters.

Accordingly, the upstream coating bead flow instability is driven by the disparity between the extensional and shear viscosity of the liquid at the deformation rates that are present in the upstream region of the coating bead of conventional knife coaters. To prevent the occurrence of the flow instability, the extension rates in the upstream coating bead must be reduced to reduce the extensional-shear viscosity disparity. The extension rates in the upstream region of the coating bead are approximately equal to the ratio of the velocity of the moving web to the clearance between the web and the upstream side of the knife coater in the vicinity of the coating bead. Gravity-fed, die-fed, and trough-fed knife coaters feature upstream knife clearances in the range of 0.1 to 1 mm (0.004 to 0.040 in). At modest web speeds such as 0.5 m/sec (100 ft/min), clearances of this magnitude create extension rates in the range of 500 to 5000 $sec^{-1}$.

The present invention method operates a knife coater to prevent the occurrence of the upstream coating bead flow instability. This is accomplished by insuring that the coating liquid can extend over a much larger distance, and thus, experience much lower extension rates in the upstream region of the coating bead. Preferably, the acceleration distance in the upstream region of the coating bead ranges from 0.5 to 12.7 cm (0.2 to 5 in). At web speeds of 0.5 m/sec (100 ft/min), the increased distance for extension would lower the extension rates experienced by the liquid by two orders of magnitude to the range of 4 to 40 sec–1. The reduction in extension rates greatly reduces the disparity between the extensional and shear viscosity of the liquid in the upstream region of the coating bead. In addition, the path of the upstream liquid-air interface of the coating bead is flattened, which aids in the elimination of the upstream coating bead flow instability.

Figure 6:
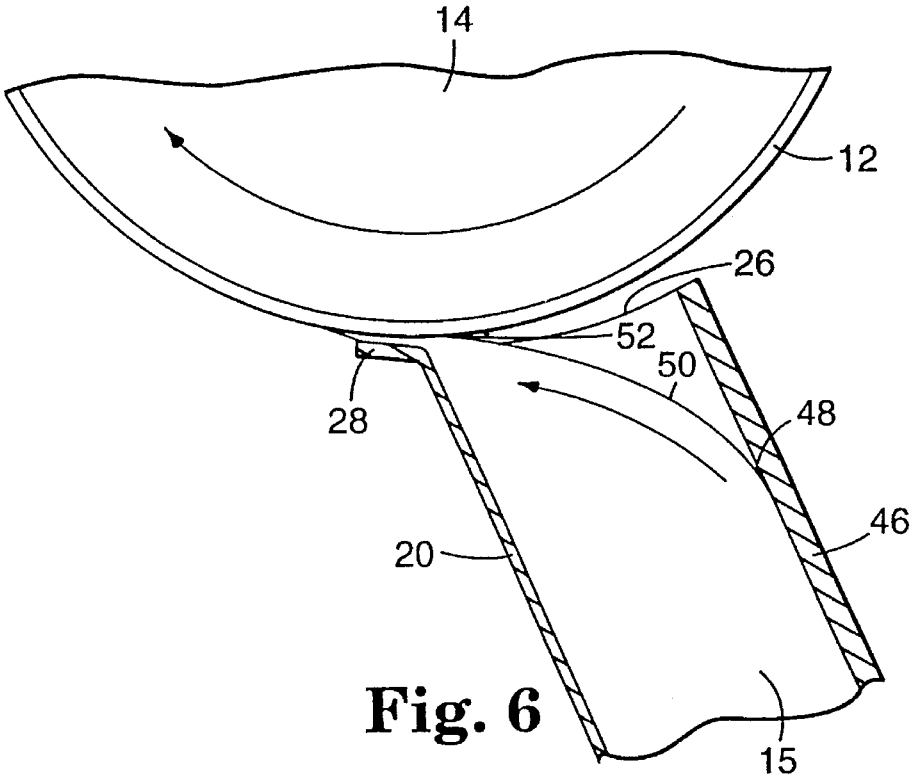
FIG. 6 is a schematic side view partially in cross section of the tension ascension knife coater.

FIG. 6 shows a coater which uses the tension ascension knife coating method. As shown, the surface to be coated is a web 12 passing around a backup roller 14 which can be deformable. Alternatively, coatings can be transferred to the substrate using intermediate components such as transfer rollers. Other fluids also can be coated and the substrate can be coated in a free span.

The coater includes a trough 15 having an opening 26 which extends transversely across at least the desired width of the coating. The web 12 moves through the coating station above the trough opening 26. The region of clearance between the web 12 and the downweb side of the trough 15 is the knifing passage, through which the coating liquid flows to form the coating. A knife 28 regulates the thickness of the coating liquid applied on the web 12. The knife 28 can be a separate element attached to the trough wall 20 or it can be a surface of the wall. The knife 28 can be planar, curved, concave, or convex. The knife 28 or the backup roller 14 can be flexible, with the gap between the knife 28 and the web 12 being sustained by hydrodynamic pressure.

The trough 15 has an opposing, upweb wall 46. The separation line 48 (which is the intersection line of the coating liquid, the upweb wall 46 of the trough 15, and the surrounding air (or other gas) is located on the upweb wall 46 of the trough 15. The upstream liquid-air interface 50 is the surface that connects the separation line 48 with the wetting line 52 located at the first contact of the liquid with the moving web 12. (The wetting line is the intersection line of the coating liquid, the web 12, and the surrounding air.) The upstream region of the coating bead is the region in the immediate vicinity of the upstream liquid-air interface 50. Coating liquid is fed into the trough by a pump by means such as through a manifold having a slot and a cavity, a single feedport or multiple feedports.

Operation of this tension ascension knife coater includes maintaining a large enough distance between the intersection lines 48, 52 that upstream coating bead flow instability does not occur. This distance is ordinarily greater than 0.5 cm (0.2 in). The distance between the lines 48 and 52 is controlled by the rate of liquid inflow into the trough and the rate of liquid outflow through the knifing passage. Maintaining the liquid inflow at a lower value than the liquid outflow from the trough lowers the liquid level in the trough and increases the distance between the intersection lines 48 and 52. When this distance is large enough that the upstream coating bead flow instability does not occur, the liquid level in the trough and the distance between the intersection lines 48 and 52 can be held constant by maintaining the liquid inflow and outflow substantially equal.

Operating the knife coater with a relatively long upstream air-liquid interface insures that the extension rates which the liquid experiences in the upstream region of the coating bead are smaller than those of known knife coaters. As a result, the disparity between the shear and extensional viscosities of the liquid in the upstream region of the coating bead is diminished and the upstream coating bead flow instability and its accompanying coating defects are eliminated. In addition, the upstream liquid-air interface is relatively flat which provides additional protection from the upstream coating bead flow instability. The liquid can maintain a long and straight upstream air-liquid interface by the interaction of tensile forces from the extensional properties of elastic liquids with gravitational forces. Tensile forces enable the coating liquid to be continuously ascended against the pull of gravitational forces from the trough opening into the knifing passage by the movement of the web. The excess liquid is returned to the trough by the knifing passage.

If the distance between the intersection lines 48 and 52 is too large, the upstream liquid-air interface 50 will rupture and continuous coating of the moving web 12 will cease. The rupture distance at which rupture of the upstream air-liquid interface occurs depends on several conditions including the rheological properties of the coating liquid and the web speed. Larger rupture distances are observed with coating liquids that have more elastic rheological properties (larger extensional viscosity). Also, the rupture distance generally increases linearly with increasing web speed. Coating liquids with very little elastic nature have very small rupture distances (less than 0.5 cm).

Various changes and modifications can be made in the invention without departing from the scope or spirit of the invention. For example, when the web is coated in a free, unsupported, span, the clearance between the trough and the web are sustained by hydrodynamic pressure, which balances the pressure from the deflection of the tensioned web.

We claim:

1. A method of applying a coating fluid having a thickness on to a surface using a trough coating apparatus having a trough and a knife, the method comprising:

providing relative movement between the coating apparatus and the surface;

applying the coating fluid to the surface through a trough opening which extends transversely across the surface by ascending the coating upwardly;

feeding the coating fluid directly into the trough;

regulating the thickness of the coating applied on the surface using a knife; and maintaining a sufficient distance between a separation line, which is the intersection line of the coating fluid, the upweb side of the trough, and the surrounding gas, and a wetting line, which is the intersection line of the coating fluid, the surface to be coated, and the surrounding gas, to maintain flow in an upstream coating bead substantially uniform in a crossweb direction to eliminate upstream coating bead flow instability.

2. The method of claim 1 wherein the applying step comprises applying the coating fluid to the surface through a trough opening which extends transversely across at least a desired width of the coating.

3. The method of claim 1 wherein the distance between the separation line and the wetting line is greater than 0.5 cm.

4. The method of claim 1 wherein the coating fluid is an elastic liquid having a ratio of extensional viscosity to shear viscosity greater than 10.

5. The method of claim 1 wherein the separation line is located below the knifing passage, which is the clearance between the knife and the surface.

6. The method of claim 1 further comprising the step of controlling the distance between the separation line and the wetting line by a rate of liquid inflow into the trough and a rate of liquid outflow through the knifing passage.

7. The method of claim 1 wherein a liquid-gas interface is a surface that connects the separation line and the wetting line and wherein the liquid-gas interface is substantially flat.

8. The method of claim 1 further comprising the step of selecting rheological properties of the coating liquid and web speed to determine a distance between the separation line and the wetting line at which the upstream coating bead ruptures.

* * * * *